US010668608B2

(12) United States Patent
Meyer

(10) Patent No.: US 10,668,608 B2
(45) Date of Patent: Jun. 2, 2020

(54) FASTENER DRIVING TOOL

(71) Applicant: Illinois Tool Works Inc., Glenview, IL (US)

(72) Inventor: Robert J. Meyer, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 419 days.

(21) Appl. No.: 15/401,654

(22) Filed: Jan. 9, 2017

(65) Prior Publication Data

US 2017/0225309 A1 Aug. 10, 2017

Related U.S. Application Data

(60) Provisional application No. 62/293,564, filed on Feb. 10, 2016.

(51) Int. Cl.

| | |
|---|---|
| ***B25C 1/04*** | (2006.01) |
| ***B25F 5/02*** | (2006.01) |
| ***B25C 1/00*** | (2006.01) |

(52) U.S. Cl.

CPC ..... *B25C 1/047* (2013.01); *B25C 1/008* (2013.01); *B25C 1/04* (2013.01); *B25F 5/02* (2013.01)

(58) Field of Classification Search

CPC ..... B25C 1/047; B25C 1/04; B25C 1/008; B25C 1/08; B25F 5/02; B25F 5/00;
(Continued)

(56) References Cited

U.S. PATENT DOCUMENTS 4,406,064 A 9/1983 Goss
4,483,473 A 11/1984 Wagdy
(Continued)

FOREIGN PATENT DOCUMENTS

DE 102004032788 A1 2/2006
EP 1 231 028 A2 8/2002
(Continued)

OTHER PUBLICATIONS

European Patent Office as International Searching Authority, International Search Report and Written Opinion in corresponding PCT Application No. PCT/US2017/012837, dated Apr. 24, 2017 (14 pages).
Canadian Office Action for Canadian Application No. 3,013,193 dated May 3, 2019 (5 pages).
Paslode® Model PF350-S Strip Nailer Operating Manual and Schematic, Apr. 2009 (16 pages).
(Continued)

*Primary Examiner* — Hemant Desai
*Assistant Examiner* — Christopher Robin Kim
(74) *Attorney, Agent, or Firm* — Neal, Gerber & Eisenberg LLP

(57) ABSTRACT

A pneumatic powered fastener driving tool including a housing including a main compartment and a handle extending from the main compartment and an end plug removably attachable to the handle, the end plug including a mounting base attachable to a bottom section of the handle, a pneumatic connector receiver extending outwardly from the mounting base, a belt hook receiver extending outwardly from the mounting base, and a mounting bracket extending downwardly from the mounting base. The tool further includes a belt hook with limited rotation. The present disclosure also provides the fastener driving tool end plug removably attachable to a handle of a pneumatic powered fastener driving tool and a limited rotation belt hook attachable to the pneumatic powered fastener driving tool end plug.

14 Claims, 6 Drawing Sheets

(58) Field of Classification Search
CPC .... B25F 3/00; B25H 3/006; A45F 2200/0575; A45F 5/021; Y10S 224/904
USPC ..... 224/269
See application file for complete search history.

(56) References Cited

U.S. PATENT DOCUMENTS

| | | | | |
|---|---|---|---|---|
| 4,522,162 | A | 6/1985 | Nikolich | |
| 4,787,145 | A | 11/1988 | Klicker et al. | |
| 5,265,312 | A | 11/1993 | Okumura | |
| 5,452,835 | A | 9/1995 | Shkolnikov | |
| 6,145,724 | A | 11/2000 | Shkolnikov et al. | |
| 6,321,622 | B1 | 11/2001 | Tsuge | |
| 6,543,664 | B2 | 4/2003 | Wolfberg | |
| 6,592,014 | B2 | 7/2003 | Smolinski | |
| 6,612,476 | B2 | 9/2003 | Smolinski | |
| 6,679,414 | B2 | 1/2004 | Rotharmel | |
| 6,695,192 | B1 | 2/2004 | Kwok | |
| 6,808,101 | B2 | 10/2004 | Laubach et al. | |
| 7,055,729 | B2 | 6/2006 | Taylor et al. | |
| 7,107,944 | B1 | 9/2006 | Heinzen | |
| 7,191,927 | B2 | 3/2007 | Segura | |
| 7,222,767 | B1 | 5/2007 | Yang | |
| D554,963 | S | 11/2007 | Holderfield et al. | |
| 7,306,052 | B2 | 12/2007 | Vahabi-Nejad et al. | |
| 7,318,546 | B2 | 1/2008 | Segura et al. | |
| 7,341,172 | B2 | 3/2008 | Moore et al. | |
| 7,392,922 | B2 | 7/2008 | Vanstaan et al. | |
| 7,455,001 | B1 | 11/2008 | Waters | |
| 7,478,740 | B2 | 1/2009 | Shea et al. | |
| 7,571,841 | B2 | 8/2009 | Gibson et al. | |
| 7,591,249 | B2 | 9/2009 | Wagdy et al. | |
| 7,654,429 | B2 | 2/2010 | Shea et al. | |
| 7,661,568 | B2 | 2/2010 | Vanstaan et al. | |
| 7,757,920 | B2 | 7/2010 | Shea et al. | |
| 7,999,507 | B2 | 8/2011 | Heinzen | |
| 8,016,046 | B2 | 9/2011 | Zhao et al. | |
| 8,074,855 | B2 | 12/2011 | Johnson | |
| 8,087,556 | B2 | 1/2012 | Oomori et al. | |
| 8,308,034 | B2 | 11/2012 | Shibata et al. | |
| 8,348,118 | B2 | 1/2013 | Segura | |
| 9,522,464 | B2 | 12/2016 | Segura et al. | |
| 2002/0117531 | A1 | 8/2002 | Schell et al. | |
| 2002/0122707 | A1* | 9/2002 | Sakai | B25B 23/045 408/241 R |
| 2003/0132264 | A1* | 7/2003 | Smolinski | B25C 1/005 227/130 |
| 2003/0183049 | A1* | 10/2003 | Bader | B25F 5/02 81/489 |
| 2005/0015935 | A1 | 1/2005 | Bader et al. | |
| 2006/0091168 | A1 | 5/2006 | Ng | |
| 2007/0080278 | A1 | 4/2007 | Wen | |
| 2008/0185410 | A1 | 8/2008 | Oomori et al. | |
| 2009/0025515 | A1 | 1/2009 | Shibata et al. | |
| 2009/0277939 | A1 | 11/2009 | Ou | |
| 2009/0278012 | A1 | 11/2009 | Okouchi et al. | |
| 2011/0108300 | A1 | 5/2011 | Nagasaka et al. | |
| 2011/0120741 | A1* | 5/2011 | Limberg | B25F 5/026 173/170 |
| 2012/0292472 | A1 | 11/2012 | Segura et al. | |
| 2013/0043295 | A1* | 2/2013 | Gathers | A45F 5/021 227/130 |
| 2014/0097217 | A1* | 4/2014 | Walsh | A45F 5/021 224/268 |
| 2014/0097326 | A1* | 4/2014 | Brendel | B25F 5/02 248/692 |
| 2015/0040408 | A1 | 2/2015 | Francis et al. | |
| 2015/0122867 | A1 | 5/2015 | Segura | |
| 2015/0173498 | A1 | 6/2015 | Wang et al. | |
| 2015/0290791 | A1 | 10/2015 | Takahashi et al. | |
| 2017/0119137 | A1* | 5/2017 | Cirincione, II | A45F 5/00 |

FOREIGN PATENT DOCUMENTS

| | | | |
|---|---|---|---|
| EP | 1 327 500 | A2 | 7/2003 |
| EP | 1 862 264 | | 12/2007 |
| EP | 2 022 607 | A2 | 2/2009 |
| EP | 2 308 652 | A1 | 4/2011 |
| JP | 2006116685 | A | 5/2006 |
| JP | 2006181709 | A | 7/2006 |
| JP | 200928841 | A | 2/2009 |
| JP | 201046739 | A | 3/2010 |
| WO | WO 2016/177795 | | 11/2016 |

OTHER PUBLICATIONS

Image of Paslode® PowerMaster Plus, printed from http://ecs.images-amazon.com/images/1/71HV3XR5NTL.fig on Feb. 15, 2016 available prior to Feb. 10, 2016 (1 page).
Image of Paslode® Power Tool, available prior to Feb. 10, 2016, (1 page).
Image of Senco® Power Tool, available prior to Feb. 10, 2016, (1 page).
Image of Bostitch® Power Tool, available prior to Feb. 10, 2016, (1 page).
Image of Pneutools® Power Tool, available prior to Feb. 10, 2016, (1 page).
Image of Hitachi® Power Tool, available prior to Feb. 10, 2016, (1 page).

* cited by examiner

FASTENER DRIVING TOOL

PRIORITY CLAIM

This application claims priority to and the benefit of U.S. Provisional Patent Application Ser. No. 62/293,564, filed Feb. 10, 2016, entitled "FASTENER DRIVING TOOL", the entire contents of which are incorporated herein by reference.

BACKGROUND

Powered fastener driving tools are well known and commercially widely used throughout North America and other parts of the world. Powered fastener driving tools are typically electrically powered, pneumatically powered, combustion powered, or powder-activated. Powered fastener driving tools are typically used to drive fasteners (such as nails, staples, and the like) to connect a first object material, item, or workpiece to a second object material, item, or workpiece.

Various known powered fastener driving tools include: (a) a housing; (b) a power source or supply assembly in, connected to, or supported by the housing; (c) a fastener supply assembly in, connected to, or supported by the housing; (d) a fastener driving assembly in, connected to, or supported by the housing; (e) a trigger mechanism partially in, connected to, or supported by the housing; and (f) a workpiece contactor or contacting element (sometimes referred to herein as a "WCE") connected to or supported by the housing. The WCE is configured to engage or contact a workpiece and to operatively work with the trigger mechanism, such that the WCE needs to be depressed or moved inwardly a predetermined distance with respect to the housing, before activation of the trigger mechanism causes actuation of the power fastener driving tool.

Powered fastener driving tools typically have two different types of operational modes and one or more mechanisms that enable the operator to optionally select one of the two different types of operational modes that the operator desires to use for driving the fasteners. One operational mode is known in the industry as the sequential or single actuation operational mode. In this operational mode, the depression or actuation of the trigger mechanism will not (by itself) initiate the actuation of the powered fastener driving tool and the driving of a fastener into the workpiece unless the WCE element is sufficiently depressed against the workpiece. In other words, to operate the powered fastener driving tool in accordance with the sequential or single actuation operational mode, the WCE element must first be depressed against the workpiece followed by the depression or actuation of the trigger mechanism. Another operational mode is known in the industry as the contact actuation operational mode. In this operational mode, the operator can maintain the trigger mechanism at or in its depressed position, and subsequently, each time the WCE is in contact with, and sufficiently pressed against the workpiece, the power fastener driving tool will actuate, thereby driving a fastener into the workpiece.

One known commercially available pneumatic powered fastener driving tool is the PASLODE® PMP or POWERMASTER PLUS® Pneumatic Framing Nailer sold by a division of the assignee of the present application (PASLODE and POWERMASTER PLUS® are registered trademarks of Illinois Tool Works Inc.). This pneumatic powered fastener driving tool is often referred to as a framing nailer or pneumatic nailer and is generally diagrammatically illustrated in FIG. 1. This known pneumatic powered fastener driving tool 10 generally includes: (a) a housing 12 including a main compartment 14 and a handle 16 extending from the main compartment 14: (b) a power source or supply assembly (not shown) in the housing 12; (c) a pneumatic end plug 40 connected to a bottom surface of a bottom wall 18 of the handle 16; (d) a fastener supply assembly 50; (e) a fastener driving assembly (not shown); (f) a trigger mechanism 60; (g) a WCE 70; and (h) a belt hook 80 rotatably connected to the bottom wall 18 of the handle 16. The handle 16 is integrally formed with the main compartment 14 and is partially covered by a plastic protective cover 29. The bottom wall 18 of the handle 16 includes: (a) a first mount or mounting bracket 20 that facilitates attachment to the fastener supply assembly 50; (b) a second mount or retainer 22 that facilitates attachment of the belt hook 80 to the handle 16; (c) a third mount (not shown) that facilitates attachment of the pneumatic end plug 40 to the bottom wall 18 of the handle 16; and (d) an air inlet (not shown). The pneumatic end plug 40 is sized, shaped, or otherwise configured to receive an outwardly extending pneumatic connector 42 sized, shaped, or otherwise configured to connect to a pneumatic air supply hose (not shown) which supplies compressed air to this pneumatic powered fastener driving tool 10. The compressed air flows through the pneumatic connector 42 and the pneumatic end plug 40, through the air inlet (not shown) in the bottom wall 18 of the handle 16, and through one or more channels (not shown) in the handle 16 to the power source or supply assembly (not shown) in the housing 12 to power the pneumatic powered fastener driving tool 10.

One issue with this known pneumatic powered fastener driving tool 10 is that if the first mount or mounting bracket 20 breaks or cracks, the entire housing 12 pneumatic powered fastener driving tool 10 needs to be replaced because the mounting bracket 20 is integrally connected to the handle 18. Likewise, if the belt hook second mount or retainer 22 breaks or cracks, the entire housing 12 of the pneumatic powered fastener driving tool 10 needs to be replaced because the mounting bracket 22 is integrally connected to the handle 18. Since operators of this tool typically use the belt hook 80 on a regular basis throughout each work day when this tool is in use, there is repeated pressure or stress placed on the second mount or mounting bracket 22 and the entire handle 16 on a regular basis.

Another issue with this known pneumatic powered fastener driving tool 10 is that this arrangement enables the belt hook 80 to rotate 150 degrees or more. This rotation enables the belt hook 80 to sometimes be in an undesired position where the belt hook 80 extends closer to the pneumatic connector 42 when the tool is in use by the operator. This rotation also enables the belt hook 80 to sometimes be in an undesired position where the belt hook 80 extends closer to the pneumatic connector 42 when the tool is hanging on the operator's belt which can cause the tool to hang in an undesired position relative to the operator.

Accordingly, there is a need to solve the above issues.

SUMMARY

Various embodiments of the present disclosure provide a pneumatic powered fastener driving tool that solves the above issues. Various embodiments of the present disclosure also provide a pneumatic powered fastener driving tool end plug that solves the above issues. More specifically, the present disclosure provides a pneumatic powered fastener driving tool with a removable end plug that can be easily replaced if broken, and a belt hook that provides limited range of motion to avoid undesired positions.

In various embodiments of the present disclosure, the pneumatic powered fastener driving tool includes: (a) a housing including a main compartment and a handle extending from the main compartment; (b) an end plug removably attachable to the handle; (c) a power source or supply assembly positioned in the housing; (d) a fastener supply assembly connected to the housing; (e) a fastener driving assembly in the housing; (f) a trigger mechanism connected to and extending from the handle of the housing; (g) a workpiece contact element connected to the main compartment of the housing; and (h) a belt hook assembly movably connected to the end plug. In various embodiments, the pneumatic powered fastener driving tool end plug includes a mounting base attachable to a bottom section of the handle, a pneumatic connector receiver extending outwardly from the mounting base, a belt hook receiver extending outwardly from the mounting base, and a mounting bracket extending downwardly from the mounting base. In various embodiments, the pneumatic powered fastener driving tool also includes a limited rotation belt hook movable from a first or stored position to a second or in-use position, and which prevents undesired further upward rotation of the belt hook.

The present disclosure also provides a pneumatic powered fastener driving tool end plug removably attachable to a handle of a pneumatic powered fastener driving tool. In various embodiments, the pneumatic powered fastener driving tool end plug includes a mounting base attachable to a bottom section of the handle, a pneumatic connector receiver extending outwardly from the mounting base, a belt hook receiver extending outwardly from the mounting base, and a mounting bracket extending downwardly from the mounting base.

The present disclosure also provides belt hook for a pneumatic powered fastener driving tool which is attachable to an end plug and provides limited rotation or movement from a first or stored position to a second or in-use position, and which prevents undesired further upward rotation of the belt hook.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
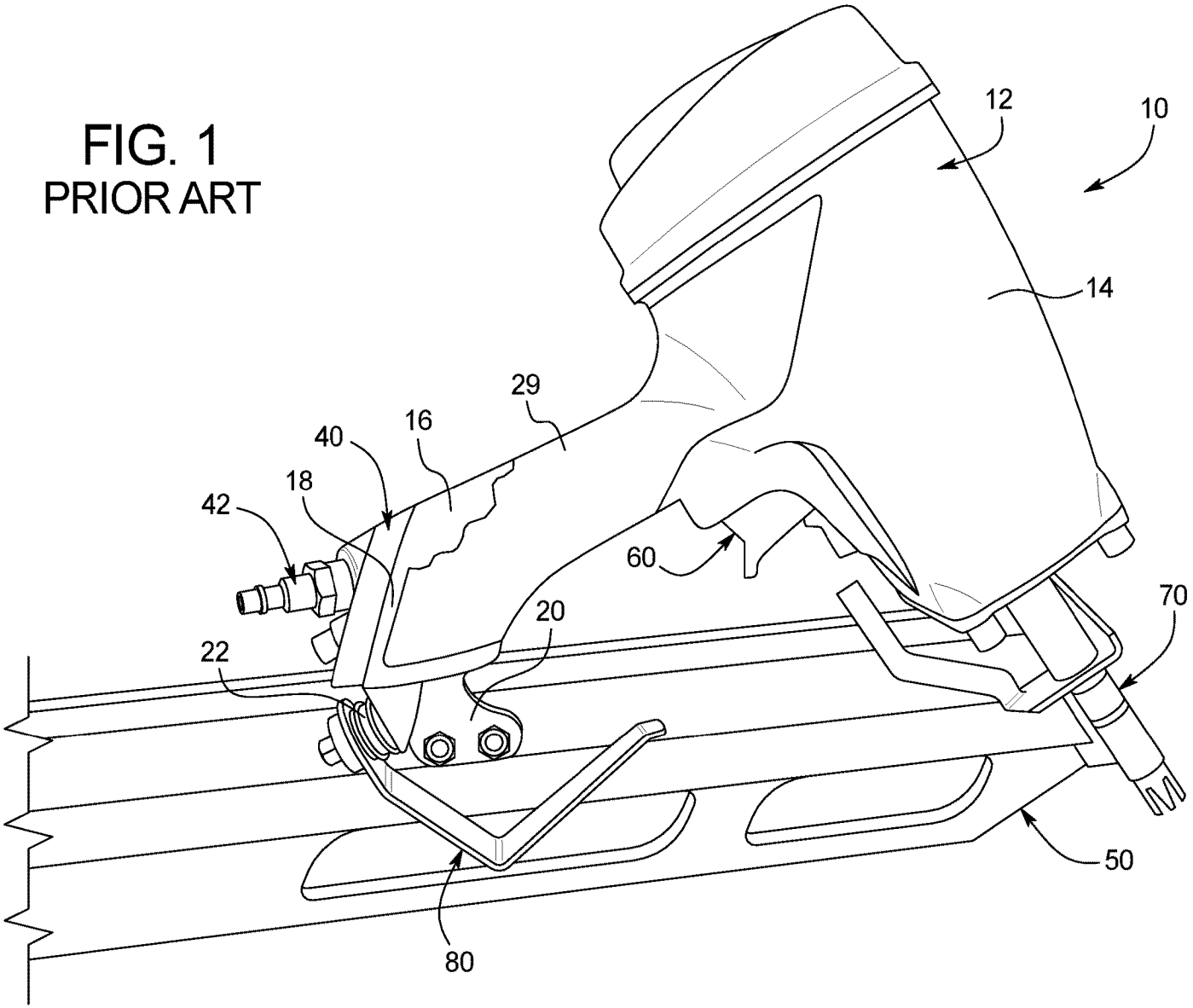
FIG. 1 PRIOR ART
FIG. 1 is a diagrammatic side perspective view of a known powered fastener driving tool and specifically a known pneumatic nailer.

Referring now to the drawings and particularly to FIGS. 2, 3, 4, 5, and 6, the powered fastener driving tool of one example embodiment of the present disclosure is generally illustrated and indicated by numeral 100. The powered fastener driving tool 100 in this illustrated embodiment is a pneumatic nailer. The powered fastener driving tool may be referred to herein as the fastener driving tool, the driving tool, the tool, the pneumatic nailer, the framing nailer, or the nailer for brevity. Such abbreviations are not meant to limit the present disclosure in any manner.

The powered fastener driving tool 100 of this illustrated example embodiment generally includes: (a) a housing 110 including a main compartment 200 and a handle 300 extending from the main compartment; (b) an end plug 400 removably attached to the handle 300; (c) a power source or supply assembly (not shown) positioned in the housing 110; (d) a fastener supply assembly 500 configured to receive fasteners (not shown) and suitably connected to or supported by the housing 110; (e) a fastener driving assembly (not shown) in the main compartment 200 of the housing 110; (f) a trigger mechanism 600 (partially shown) connected to or supported by the housing 110; (g) a WCE 700 connected to or supported by the main compartment 200 of the housing 110: and (h) a belt hook assembly 800 rotatably connected to the end plug 400.

More specifically, in this illustrated example embodiment, the housing 110 includes a main compartment 200 and a handle 300 extending from and integrally formed with the main compartment 200. The main compartment 200 includes a main housing 215 and an end cap 220 removably attachable to the main housing 215 by a plurality of attachment members such as bolts 232, 234, and 236. The main housing 215 and the end cap 220 define an interior component chamber (not shown). In one embodiment, the main housing 215 and the handle 300 are cast from or in a single mold. In other embodiments, the main housing 215 and the handle 300 can be separately formed and then integrally attached. The handle 300 includes a top section 310 adjacent to the main housing 215, a middle section 320, and a bottom section 330. The bottom section 330 includes two end plug attachment member receivers (not shown) sized, shaped, or otherwise configured to receive the attachment members, such as bolts 490 and 492, that removably attach or secure the end plug 400 to a bottom section 330 of the handle 300.

In this illustrated example embodiment, the end plug 400 includes a body 410 removably attachable to the bottom section 330 of the handle 300 by the bolts 490 and 492. More specifically, the body 410 includes: (a) a mounting base 412; (b) a pneumatic connector receiver 430 extending outwardly from the mounting base 412; (c) a belt hook receiver 450 extending outwardly from the mounting base 412; and (d) a mounting bracket 470 extending downwardly from the mounting base 412.

The mounting base 412 is sized, shaped, or otherwise configured to be positioned adjacent to the butt end or bottom end (not shown) of the bottom section 330 of the handle 300. The mounting base 412 defines two spaced apart apertures 491 and 493 sized, shaped, or otherwise configured to respectively receive the bolts 490 and 492 which secure the mounting base 412 to the butt end or bottom end (not shown) of the bottom section 330 of the handle 300. It should be appreciated that other suitable mechanisms may be employed to secure the end plug 400 to the handle 300 in accordance with the present disclosure.

The pneumatic connector receiver 430 extends outwardly from the mounting base 412 and has a partially cylindrical body 432 that defines an opening 435 sized, shaped, or otherwise configured to receive a pneumatic connector (such as the pneumatic connector 42 shown in FIG. 1). The pneumatic connector receiver 430 has a threaded interior surface 438 that defines the opening 435 and that enables the pneumatic connector to be screwed into and out of the opening 435 and thus the pneumatic connector receiver 430. In this illustrated embodiment, the pneumatic connector receiver 430 extends at an offset upwardly directed angle from the fastener supplier 500 or magazine) to ensure that the air hose is out of the way during reloading of the fastener supplier 500 or magazine.

The belt hook receiver 450 extends outwardly from the mounting base 412 and has a generally cylindrical body 452 that defines an opening 458 configured to receive an attachment member such as bolt 860. The belt hook receiver 450 has a threaded interior surface 452 which enables the attachment member such as bolt 860 to be screwed into and out of the opening 458. The belt hook receiver 450 and specifically the generally cylindrical body 452 has a relatively smooth outer surface 456 which enables the belt hook 810 to rotate about belt hook receiver 450 as further discussed below.

The mounting bracket 470 extends downwardly from the mounting base 412 and includes a leg 472 including a foot 473 which defines two openings 476 and 478 sized, shaped, or otherwise configured to receive suitable an attachment members such as bolts 477 and 479 for attaching the mounting bracket 479 and the end plug 400 to the fastener supply assembly 500.

In this illustrated embodiment, the mounting base 412, the pneumatic connector receiver 430, the belt hook receiver 450, and the mounting bracket 470 are integrally formed from a suitable metal such as steel or aluminum. It should be appreciated that the end plug can be made from other suitable materials and in other suitable shapes in accordance with the present disclosure.

In this illustrated example embodiment, a suitable gasket or washer 495 is positioned between the end plug 400 and the bottom end of the handle 300 to provide a secure air-tight connection.

In this illustrated example embodiment, the power source or supply assembly (not shown) is positioned in the housing 110 and includes one or more channels that extend through the handle 300 and which defines an air inlet (not shown) in the handle 300. This enables the pneumatic connector to communicate air from the pneumatic air supply line (not shown) to the air inlet in the handle 300 to provide pressurized air to the power source.

In this illustrated example embodiment, the fastener supply assembly 500 is configured to receive fasteners (not shown) and is connected to fastener driving assembly extending from the housing 110 and to the leg 472 of the end plug 400. The fastener supply assembly 500 is configured to supply fasteners to the fastener driving assembly.

In this illustrated example embodiment, the fastener driving assembly is partially in the main compartment 200 of the housing 110 and partially extends from the main compartment 200 of the housing 110.

In this illustrated example embodiment, the trigger mechanism 600 is partially in the upper section 310 of the handle 300 of the housing 110 and partially extends from the upper section 310 of the handle 300 of the housing 110. The trigger mechanism 600 includes a trigger which is supported by and extends from the handle 300 of the housing 110.

In this illustrated example embodiment, the WCE 700 is connected to and extends from the main compartment 200 of the housing 110.

Figure 2:
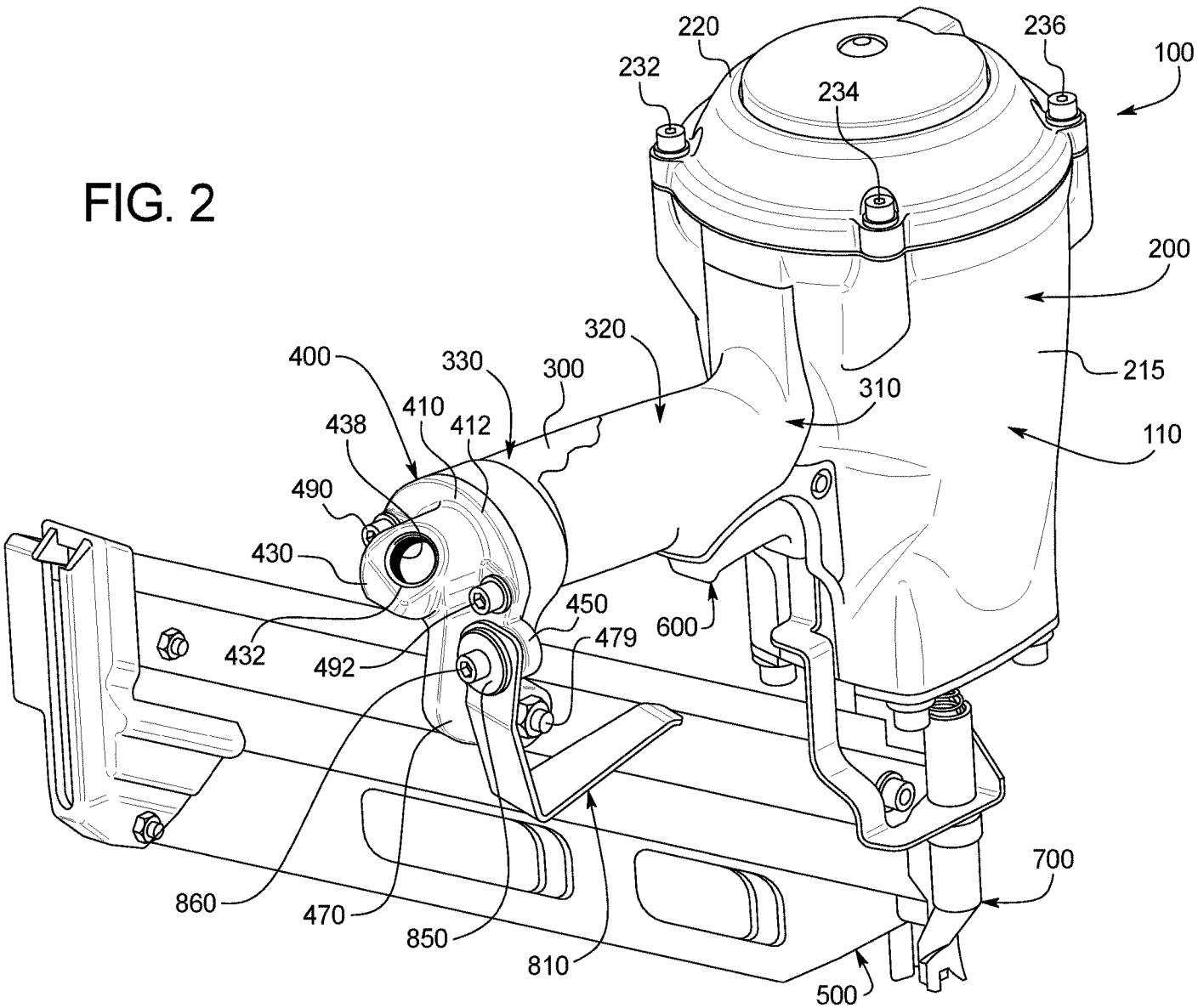
FIG. 2 is a rear perspective view of a powered fastener driving tool of one example embodiment of the present disclosure illustrating the end cap and illustrating the belt hanger in a first position.
Figure 3:
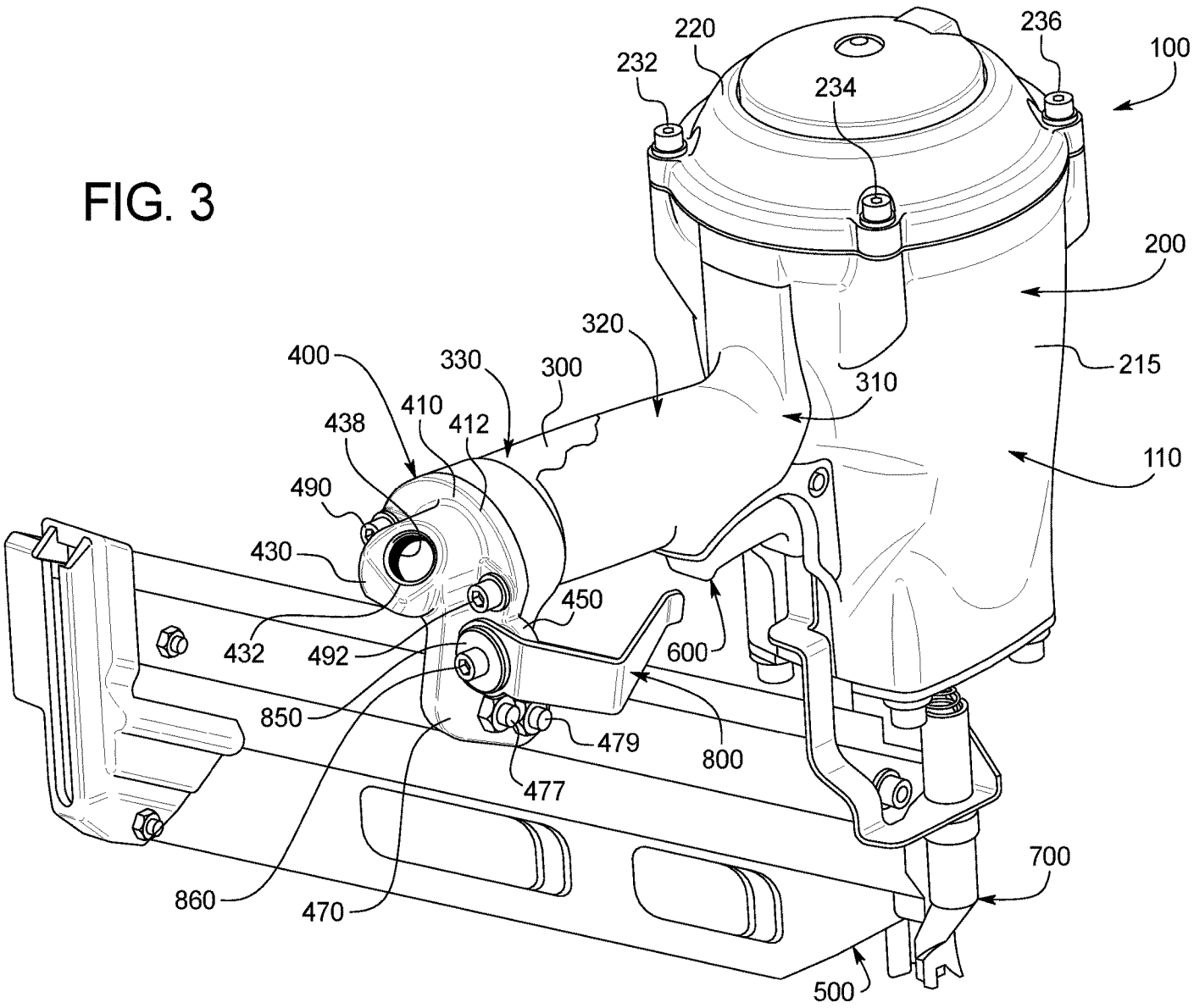
FIG. 3 is a rear perspective view of the powered fastener driving tool of FIG. 2 illustrating the end cap and also illustrating the belt hanger in a second position.

In this illustrated example embodiment, the belt hook assembly 800 is movably and, specifically, rotatably connected to the end plug 400. The belt hook assembly 800 includes a generally L-shaped belt hook 810, a spring 840, a washer 850, and an attachment member such as bolt 860. The spring 840 is sized, shaped, or otherwise configured to be positioned about or journaled about the belt hook receiver 450 of the end plug 400 as shown in FIGS. 2 and 3. The spring 840 is configured to apply suitable pressure or friction to the belt hook 810 such that the belt hook 810 can be rotated, but does not loosely rotate. The bolt 860 suitably secures the washer 850, the belt hook 810, and the spring 840 to the belt hook receiver of the end plug 400 such that the belt hook 810 is rotatable about the belt hook receiver 450 of the end plug 400 as further described below. The belt hook 810 includes a hooking hand 812 (having a hooking finger 813), an extension arm 820 connected at one end to the hooking hand 812, and a mounting shoulder 830 connected to the other end of the extension arm 820. The mounting shoulder 830 includes a body 832 defining a central opening 834 having an inner diameter larger than the outer diameter of the belt hook receiver 450 such that the belt hook 810 is rotatable about the belt hook receiver 450 of the end plug 400. The body 832 of the mounting shoulder 830 further includes: (a) a first end wall 836 having a first end plug engagement edge 837; (b) a second end wall 838 having a second end plug engagement edge 839; (c) a third end wall 840; and (d) a fourth end wall 842. The mounting shoulder further includes a curved edge 839A between edge 839 and edge 837.

Figure 4:
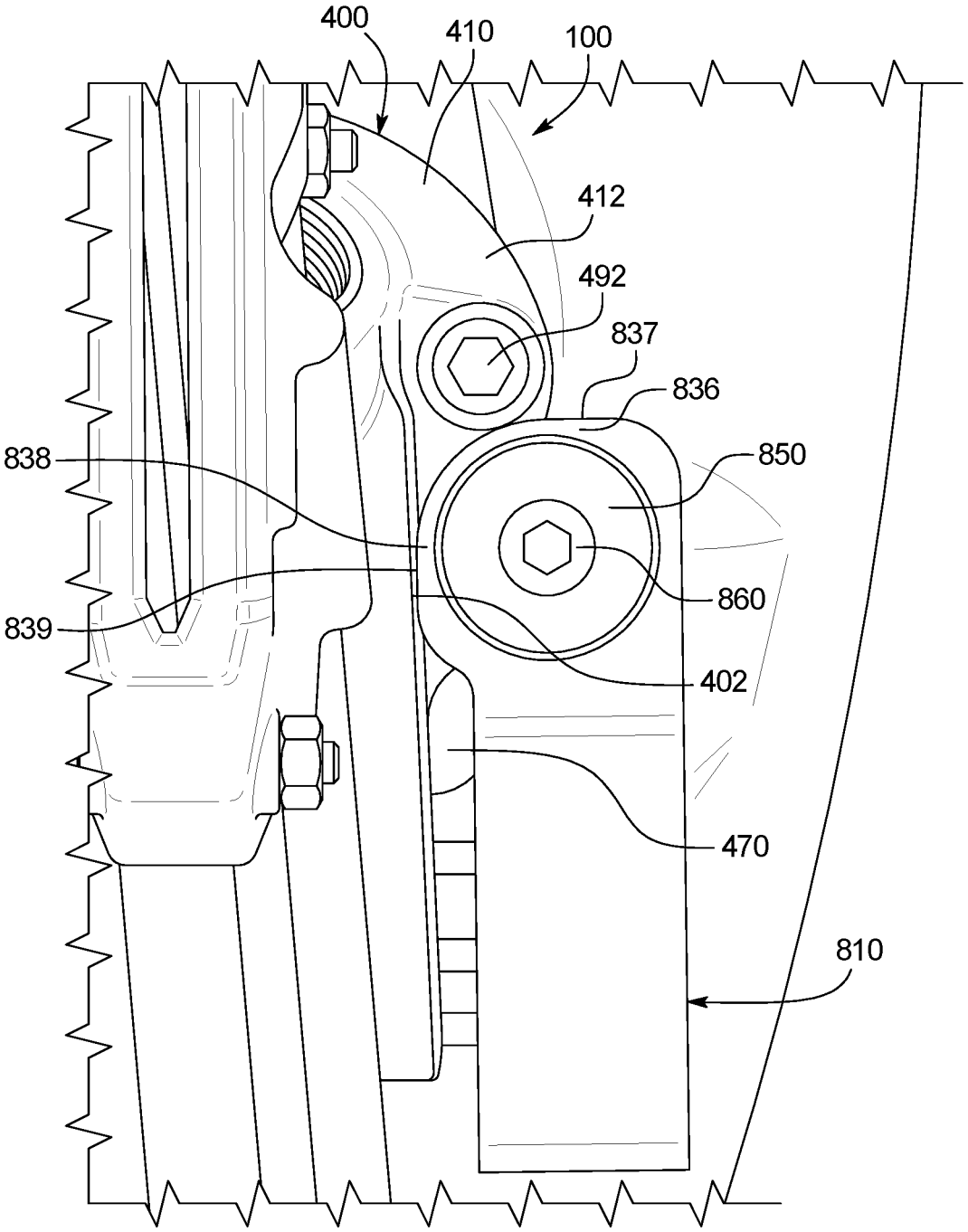
FIG. 4 is an enlarged fragmentary view of the end cap of the powered fastener driving tool of FIG. 2, and illustrating the belt hanger in the first position.
Figure 5:
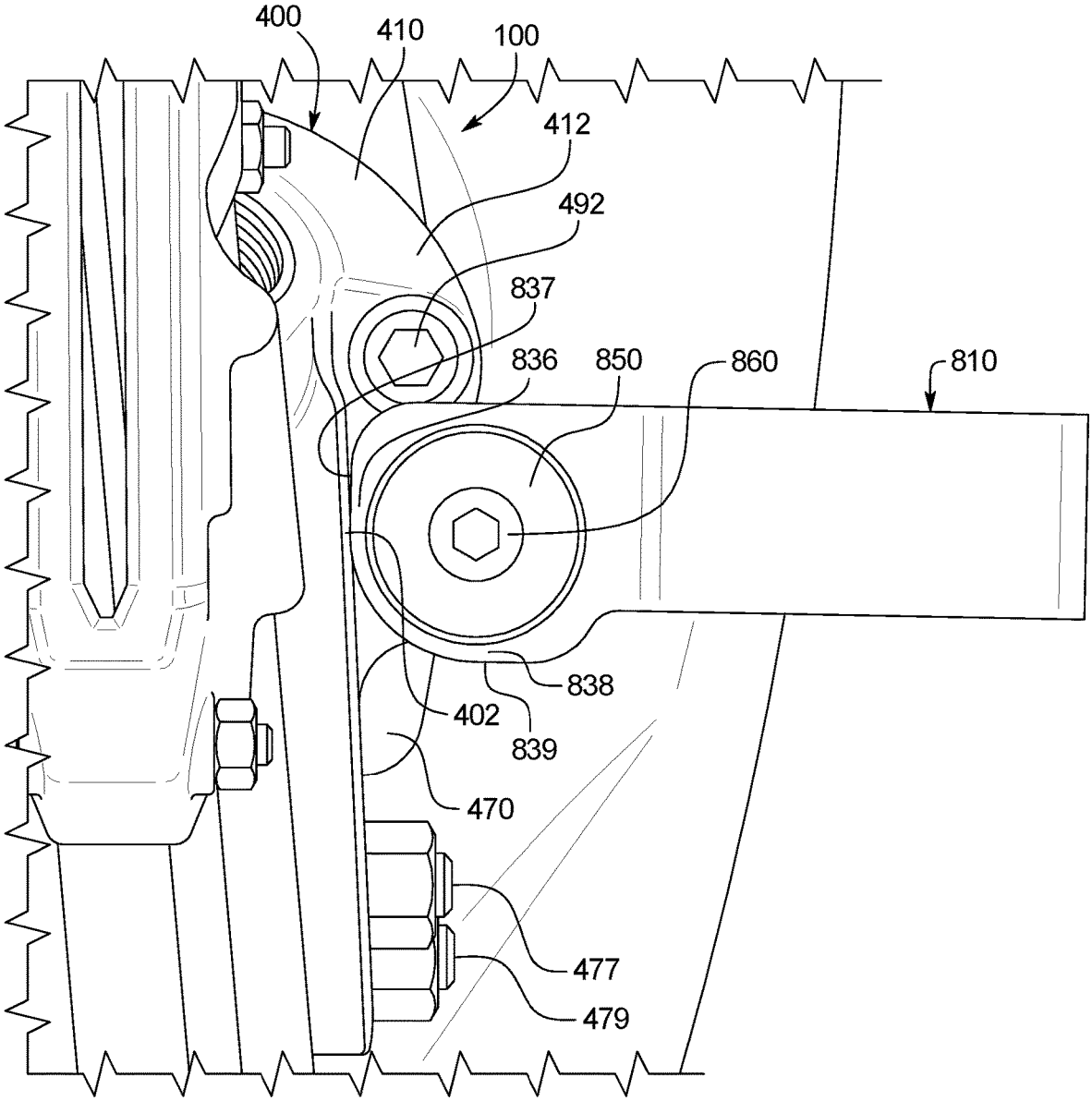
FIG. 5 is an enlarged fragmentary view of the end cap of the powered fastener driving tool of FIG. 2, and illustrating the belt hanger in the second position.
Figure 6:
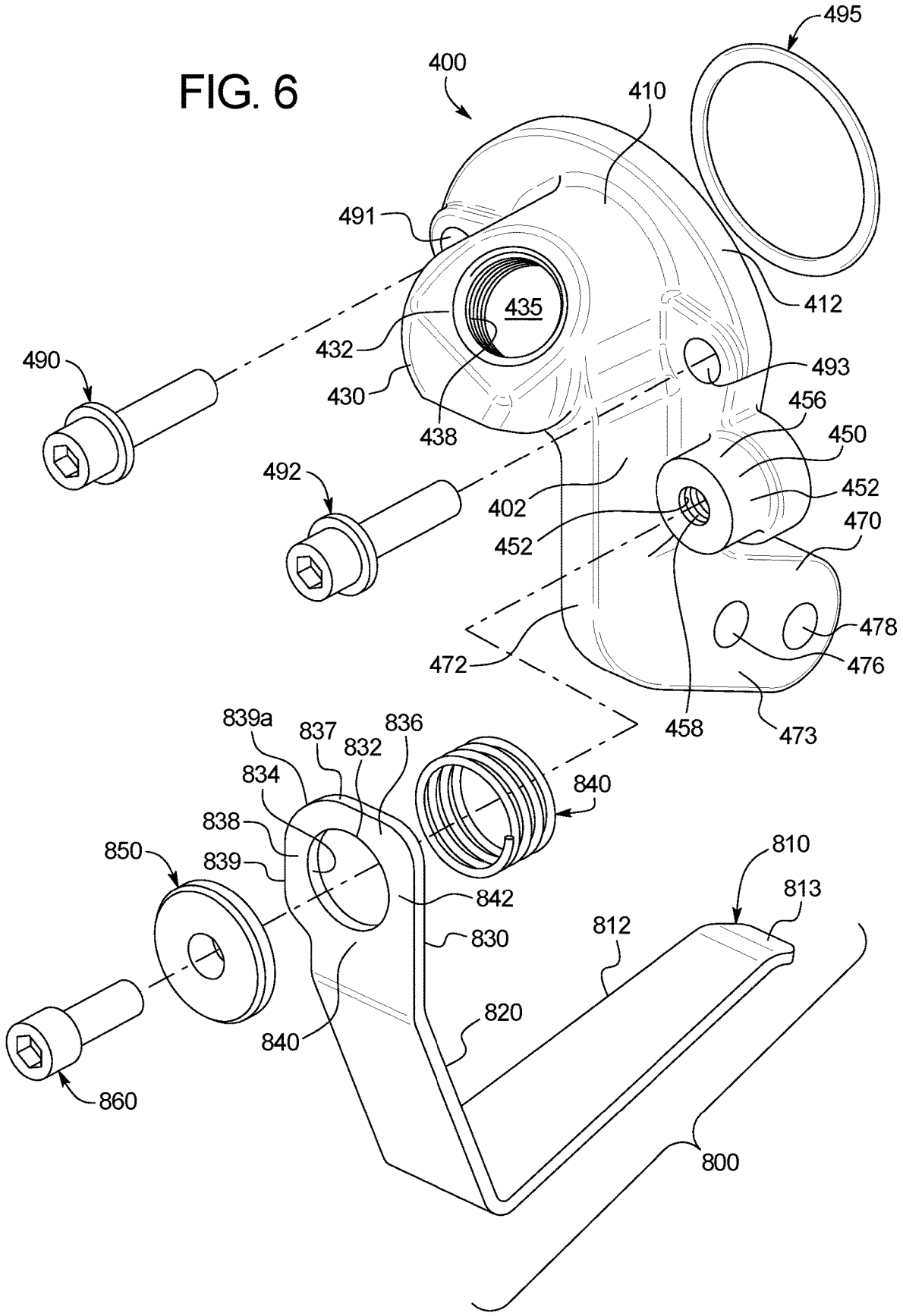
FIG. 6 is an enlarged exploded view of the end cap of the powered fastener driving tool of FIG. 2 and the belt hanger.

The belt hook 810 is rotatable from and between a first or stored position shown in FIGS. 2 and 4 to a second or in-use position shown in FIGS. 3 and 5.

In the first or stored position, the end wall 838 is adjacent to the wall 402 of the body 410 of the end plug 400, the extension leg 820 extends toward the fastener supplier 500, and the hooking hand 812 extends adjacent to the fastener supplier 500. In the first or stored position, the second end plug engagement edge 839 of the second end wall 838 engages the wall 402 but is curved or configured to allow rotation of the wall 436 relative to wall 402.

In the second or in-use position, the end wall 836 is adjacent to and engages the wall of the 402, the extension leg 820 extends outwardly, and the hooking hand 812 extends outwardly to enable an operator to hang the tool on an object such as the operator's belt. In the second or in-use position, the first end plug engagement edge 837 of the first end wall 836 engages the wall 402 to prevent further upward rotation of the belt hook 810. This prevents the belt hook 810 from further rotating upwardly to an undesired position.

The belt hook 810 is thus rotatable from a first storage position shown in FIGS. 2 and 4 to a second or in-use position shown in FIGS. 3 and 5. This enables an operator of the tool 100 to use the belt hook when desired and prevents the belt hook from moving to an undesired further upwardly rotated position.

This end plug 400 and belt hook assembly 800 configuration solve the above issues, and specifically if the mounting bracket 470 breaks or cracks, only the end plug 400 (instead of the entire housing 410) needs to be replaced.

Likewise, if the belt hook retainer 450 breaks or cracks, only the end plug 400 (instead of the entire housing 410) needs to be replaced.

It will be understood that modifications and variations may be effected without departing from the scope of the novel concepts of the present invention, and it is understood that this application is to be limited only by the scope of the claims.

The invention claimed is:

1. A powered fastener driving tool comprising:

(a) a housing including a main compartment and a handle extending from the main compartment;

(b) an end plug including a body removably attachable to the handle, the body of the end plug including a mounting base attachable to a bottom section of the handle, a pneumatic connector receiver extending outwardly from the mounting base, a belt hook receiver integrally formed with and extending outwardly from the mounting base, and a mounting bracket extending downwardly from the mounting base;

(c) a fastener supply assembly connected to the housing and configured to receive fasteners;

(d) a fastener driving assembly in the housing;

(e) a trigger mechanism supported by the housing;

(f) a workpiece contact element connected to the main compartment of the housing; and (g) a belt hook assembly rotatably connected to the belt hook receiver, the belt hook assembly including a spring circumferentially surrounding an outer surface of the belt hook receiver.

2. The powered fastener driving tool of claim 1, wherein the pneumatic connector receiver extends outwardly from the mounting base and defines an opening configured to receive a pneumatic connector.

3. The powered fastener driving tool of claim 1, wherein the belt hook receiver extends outwardly from the mounting base, has a cylindrical body that defines an opening, and the outer surface of the belt hook receiver enables a belt hook to rotate about the cylindrical body of the belt hook receiver.

4. The powered fastener driving tool of claim 1, wherein the mounting bracket extends downwardly from the mounting base and includes a leg configured to receive attachment members for attachment to the fastener supply assembly.

5. The powered fastener driving tool of claim 1, wherein the mounting base, the pneumatic connector receiver, the belt hook receiver, and the mounting bracket are integrally formed.

6. The powered fastener driving tool of claim 1, wherein the belt hook assembly includes a generally L-shaped belt hook, a washer, and an attachment member.

7. The powered fastener driving tool of claim 6, wherein the belt hook includes a hooking hand, an extension arm connected at one end to the hooking hand, and a mounting shoulder connected to the other end of the extension arm.

8. The powered fastener driving tool of claim 7, wherein the mounting shoulder includes a shoulder body defining a central opening having an inner diameter larger than an outer diameter of the belt hook receiver such that the belt hook is rotatable about the outer surface of the belt hook receiver of the end plug.

9. The powered fastener driving tool of claim 8, wherein the shoulder body of the mounting shoulder includes a first end wall having a first end plug engagement edge and a second end wall having a second end plug engagement edge, the second end plug engagement edge of the second end wall configured to engage a wall of the end plug and allow rotation of the second end wall relative to the wall of the end plug, and the first end plug engagement edge of the first end wall configured to engage the wall of the end plug and prevent further rotation of the first end wall relative to the wall of the end plug.

10. A powered fastener driving tool end plug comprising:

a mounting base;

a pneumatic connector receiver extending outwardly from the mounting base;

a belt hook receiver integrally formed with and extending outwardly from the mounting base;

a mounting bracket extending downwardly from the mounting base; and a belt hook assembly rotatably connected to the belt hook receiver, the belt hook assembly including a spring circumferentially surrounding an outer surface of the belt hook receiver.

11. The powered fastener driving tool end plug of claim 10, wherein the pneumatic connector receiver extends outwardly from the mounting base and defines an opening configured to receive a pneumatic connector.

12. The powered fastener driving tool end plug of claim 10, wherein the belt hook receiver extends outwardly from the mounting base, has a cylindrical body that defines an opening, and the outer surface of the belt hook receiver enables a belt hook to rotate about the cylindrical body of the belt hook receiver.

13. The powered fastener driving tool end plug of claim 10, wherein the mounting bracket extends downwardly from the mounting base and includes a leg configured to receive attachment members for attachment to a fastener supply assembly.

14. The powered fastener driving tool end plug of claim 10, wherein the mounting base, the pneumatic connector receiver, the belt hook receiver, and the mounting bracket are integrally formed.

* * * * *